United States Patent [19]

Stewart

[11] Patent Number: 4,858,249

[45] Date of Patent: Aug. 22, 1989

[54] SHOULDER STRAP FASTENING DEVICE

[76] Inventor: Deborah L. Stewart, 14 Elm St., Acton, Mass. 01720

[21] Appl. No.: 254,250

[22] Filed: Oct. 6, 1988

[51] Int. Cl.[4] ..... A41F 19/00; A44B 18/00

[52] U.S. Cl. ..... 2/305; 2/326; 2/DIG. 6; 24/306; 24/442

[58] Field of Search ..... 24/442, 300, 371, 16 R, 24/306, 519, 265 C, 3 C; 128/DIG. 15; 2/DIG. 6, 305, 310, 312, 321, 325, 326

[56] References Cited

U.S. PATENT DOCUMENTS

| | | | |
|---|---|---|---|
| 290,958 | 12/1883 | Atwood | 2/326 |
| 722,741 | 3/1903 | Nye | 2/305 |
| 1,410,306 | 3/1922 | Hoffmann et al. | 24/300 |
| 2,440,982 | 5/1948 | Speller et al. | 2/305 |
| 3,383,738 | 5/1968 | Fox et al. | 24/306 |
| 3,688,348 | 9/1972 | Klotz et al. | 24/306 |
| 4,481,682 | 11/1984 | Hall | 2/DIG. 6 |
| 4,728,326 | 3/1988 | Gilles | 128/DIG. 15 |

FOREIGN PATENT DOCUMENTS

| | | | |
|---|---|---|---|
| 1374231 | 8/1964 | France | 2/DIG. 6 |

*Primary Examiner*—Victor N. Sakran

*Attorney, Agent, or Firm*—Weingarten, Schurgin, Gagnebin & Hayes

[57] ABSTRACT

A shoulder strap organizer operative to secure the shoulder straps, either in the front or back of a garment, particularly a child's garment, in place, preventing their falling off the shoulders which results in loss of garment support. The shoulder strap organizer is provided with hook and pile or similar release-fastening material, to permit it to form two loops, which are fully adjustable around each of the shoulder straps. The body of the shoulder strap organizer is typically a nylon web material which can be washed when desired. It is a convenient aftermarket item which can be used with any garment that has shoulder straps. The preferred use position for a child is in the rear, making the child less aware of its presence and less likely to remove it. An adult user may wear it in the front where it is more easily affixed.

5 Claims, 1 Drawing Sheet

SHOULDER STRAP FASTENING DEVICE

FIELD OF THE INVENTION

This invention relates to devices for securing shoulder straps in place, and more specifically, to a shoulder strap organizer with hook and pile or similar release-fastening material for securing the shoulder straps of a child's garment in place, preventing their lateral displacement.

BACKGROUND OF THE INVENTION

Many garments are held up by shoulder straps which loop over respective right and left shoulders of the wearer between front and rear waist attachment locations.

As a result of imperfect fit of the garment and straps, the wearers activity or garment abuse and other factors, the straps have a tendency to fall off the shoulders with a resulting loss of garment support. In the infant's case, he is not able to restore the straps, even if aware of them being displaced. In the case of adult wearers, the repeated loss of one or more straps from the shoulders could become a distracting nuisance or hazard, particularly in activities requiring continuous use of both hands.

Various means have been employed in attempting to eliminate this potential hazard. These include twisting the shoulder straps together, having one strap pass through a slot in the second strap, having the garment extend toward the shoulders in the rear such that the straps are shorter in length, sewing the straps together in an X configuration, or tying them with a piece of string, shoelace, or other material. These attempts cause one or more problems including limitations on fit, ease of dressing, etc.

Therefore, it is desirable to have a means for securing the shoulder straps of a garment in place by an adaptable, convenient and inexpensive device that can be applied after dressing.

SUMMARY OF THE INVENTION

The present invention comprises a shoulder strap organizer made of a material such as nylon web with a hook and pile or similar release-fastening material, attached by sewing, adhesive or other convenient means which permit the shoulder strap organizer to form two loops of adjustable size one around each shoulder strap for securing the shoulder straps of a garment, particularly a child's garment, in place, preventing their lateral displacement and loss of garment support. The preferred use position of the organizer for a child is in the rear, making the child less aware of its presence and less likely to remove it. An adult user may wear it in the rear or the front where it is more easily affixed.

The shoulder strap organizer is typically a nylon web of about 10 inches length for a child's garment. The outer inch or two on one side at each end is provided with a male or female strip of hook and pile release-fastener material such as VELCRO. The center two or three inches of the same side of the shoulder strap organizer is provided with a length of the mating release-fastener.

In use each half of the shoulder strap organizer is folded around a respective shoulder strap resulting in the shoulder straps being restrained from slipping off the shoulders. The hook and pile type of fastener imparts adjustability in how closely the shoulder straps are held together, accommodating various fits and sizes, and further prevents slippage of the shoulder strap organizer along the shoulder straps.

DESCRIPTION OF THE DRAWING

The invention will be more fully understood from the following solely exemplary detailed description taken in conjunction with the accompanying drawing, in which.

DESCRIPTION OF THE INVENTION

The present invention contemplates a shoulder strap organizer which is intended for use to secure the shoulder straps typically of a child's, infant's or adult's strapped garment in position so as to prevent their accidental or intentional displacement over a shoulder.

Figure 1:
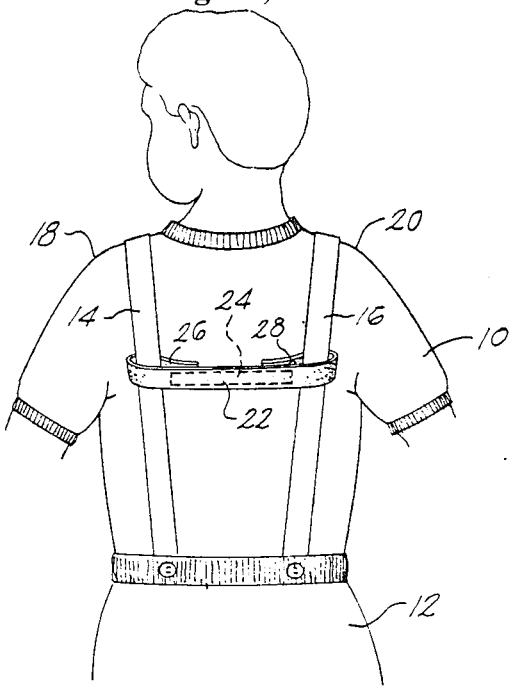
FIG. 1 is an illustration of the invention in use on overalls being worn by a child.

The invention is illustrated in use in FIG. 1 in which an individual 10, which may be a child or infant, is wearing a pair of pants 12 to which a pair of shoulder straps 14 and 16, shown at the rear of the individual 10, circle over respective shoulders 18 and 20 and join front portions of the pants 12, not shown, so as to hold the pants in place.

As often happens in play or school activities, or in work or social applications for adult garments, the straps 14 and/or 16 may fall off the shoulders 18 and 20 by accident or intent. In the case of children or infants, who are typically unable to restore the straps to their normal position even if they were aware of the strap slipping off, the potential hazard is the loss of support and displacement of the pants 12. In the case of adult wearers the repeated loss of one or more straps from the shoulder area can become a distracting nuisance particularly in work or social activities requiring continuous use of both hands.

Figure 2:
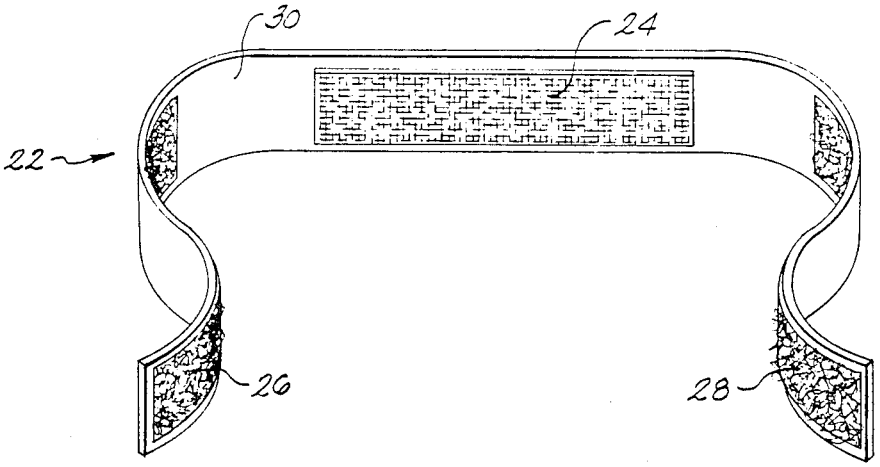
FIG. 2 is a close up illustration of the invention in open condition ready for use.

A shoulder strap organizer 22 according to the present invention is attached around the shoulder straps 14 and 16 preventing them from lateral displacement over the shoulders 18 and 20. With additional reference to FIG. 2 the shoulder strap organizer 22, in order to accomplish this function, comprises a VELCRO strip 24 (or any other hook and pile or similar release-fastening material) and first and second facing and mating fastening strips 26 and 28 on a body portion 30. In the view of FIG. 1 the mating portions 26 and 28 are illustrated in secured attachment to the strip 24 thus holding the shoulder strap organizer 22 in position, keeping the shoulder straps 14 and 16 from displacement over the shoulders.

It is additionally beneficial that the release-fastening strips 26, 28, and 24 extend toward each other sufficiently so that a portion of them or each of them confronts each of the shoulder straps 14 and 16. Since the shoulder straps 14 and 16 are likely to be slightly "fuzzy" the placement of the strap portions 26, 28 and 24 in those locations helps to hold the shoulder strap organizer 22 in position and prevents it from sliding toward the pants 12 where it would tend to be less effective.

Release-fastening strips 24, 26 and 28 are attached to body portion 30 by sewing, adhesive or any other convenient means. The material 30 is typically a nylon web material in order to provide some body to the strap 22 so that it retains its shape as illustrated. The dimensions of the strap are defined solely by the function which it is to perform and sizes may vary depending upon the size of the pant garment 12 to which it is to be associated. For a child, the overall length can be about 10 inches, the strips 26 and 28 about 1½ inches and strip 24 about 3 inches. One size of shoulder strap organizer 22 will accommodate a wide range of applications.

The shoulder strap organizer 22 can be easily removed and used with other garments, not necessarily requiring washing between uses. It nevertheless is susceptible to easy and safe washing when desired. The strap 22 thus provides a convenient after market item for which the user need only obtain a lesser number than the actual number of garments in the user's wardrobe.

The preferred position of use for a child or infant for the shoulder strap organizer 22 is to the rear which makes the child less aware of its presence and unlikely to take action to remove it. The adult user may wear it either in the rear or in the front where it might on certain occasions be more easily affixed.

The shoulder strap organizer is disclosed in use on a child's overalls, it being understood that such illustration merely exemplifies the utility of the strap to organize a child's shoulder straps and that the shoulder strap organizer is not limited to this application. The shoulder strap organizer may be used to secure the straps of any garment which has shoulder straps. The use of VELCRO as the hook and pile release-fastener makes the strap easy to use and fully adjustable for any size garment.

It will be understood that all matter herein described or shown in the accompanying drawing is to be interpreted as illustrative only and is not to limit the invention.

I claim:

1. A shoulder strap organizer for use on garment shoulder straps comprising:

a single elongated strip having a length slightly longer than twice the outside edge separation of garment shoulder straps with which said organizer is intended to be used;

a first length of hook and pile release-fastening material of one fastening type bolded to a first side of said strip in a central region thereof;

second and third lengths of release-fastening material of a type mating with said one fastening type and bonded to said first side of said strip at opposing ends thereof and separated from said first length by a distance sufficient to permit 180 degree flexing of said strip between said first length and said second and third lengths respectively;

said first, second, and third lengths adapted for attaching said single strip to said first and second straps in such a manner that first and second loops are formed by mating said first length to said second and third lengths respectively, each loop encompassing a respective one of said first and second shoulder straps;

said first, second and third lengths being further adapted for tightening shoulder straps by adjusting said strip without movement of said strip up or down.

2. A shoulder strap organizer as recited in claim 1, wherein said release-fastening material is VELCRO.

3. A shoulder strap organizer as recited in claim 1, wherein said strap is a nylon web.

4. A shoulder strap organizer as recited in claim 1, wherein said strip is 9¾ inches long and one inch wide.

5. A method for securing garment shoulder straps on the shoulders which comprises:

attaching the apparatus of claim 1 to garment shoulder straps in such a manner that first and second loops are formed each loop encompassing a first and second shoulder strap, securing garment shoulder straps on the shoulders by adjusting said first and second loops of the apparatus of claim 1 to provide more or less tension on garment shoulder straps.

* * * * *